US009933221B2

(12) United States Patent
Fiedorowicz

(10) Patent No.: US 9,933,221 B2
(45) Date of Patent: Apr. 3, 2018

(54) GUN BARREL COOLER

(71) Applicant: Area 1 Sports LLC, Waukesha, WI (US)

(72) Inventor: Walter J. Fiedorowicz, North Prairie, WI (US)

(73) Assignee: Area 1 Sports, LLC, North Prairie, WI (US)

( * ) Notice: Subject to any disclaimer, the term of this patent is extended or adjusted under 35 U.S.C. 154(b) by 0 days.

(21) Appl. No.: 15/236,391

(22) Filed: Aug. 12, 2016

(65) Prior Publication Data

US 2017/0045322 A1 Feb. 16, 2017

Related U.S. Application Data

(60) Provisional application No. 62/204,054, filed on Aug. 12, 2015.

(51) Int. Cl.
*F41A 13/04* (2006.01)
*F41A 13/10* (2006.01)

(52) U.S. Cl.
CPC ..... *F41A 13/10* (2013.01); *F41A 13/04* (2013.01)

(58) Field of Classification Search
CPC ..... F41A 13/00; F41A 13/04; F41A 13/06; F41A 13/10; F41A 29/00; F41A 29/04; F41B 11/62; F41B 9/005; F42B 5/145; F42B 8/08; F42B 5/24
USPC ..... 124/57; 89/14.1, 1.25; 102/440, 435
See application file for complete search history.

(56) References Cited

U.S. PATENT DOCUMENTS 789,687 A * 5/1905 Edwards et al. ..... F41A 13/10 89/1.2
1,128,639 A * 2/1915 Tsukalas et al. ..... F41A 29/04 89/1.2
1,160,778 A * 11/1915 Smart ..... F41A 13/04 89/1.2
1,216,939 A 2/1917 Brotherston
2,188,741 A 1/1940 Roberts
2,273,839 A 2/1942 De Port et al.
2,416,768 A * 3/1947 Monner ..... F41A 13/04 89/14.1
2,427,374 A * 9/1947 Walker ..... F41A 13/04 89/14.1
2,594,778 A 4/1952 Hoard
(Continued)

FOREIGN PATENT DOCUMENTS

DE 40 22 542 1/1992

*Primary Examiner* — Derrick R Morgan
(74) *Attorney, Agent, or Firm* — Boyle Fredrickson S.C.

(57) ABSTRACT

A gun barrel cooler for cooling a firearm, such as an automatic, semi-automatic, bolt action or lever action rifle that includes a centrifugal fan blower with an intake to which ambient barrel coolant air is discharged from the blower where the air flows through a conduit that preferably is a flexible hose, through a coupling used to couple the hose to a barrel coolant discharge nozzle, and out the nozzle into the barrel of the gun desired to be cooled. The nozzle is three dimensionally shaped to substantially conform to the firing chamber of the gun to provide better sealing during cooling. A preferred nozzle is an empty cartridge case of substantially the same caliber as the gun to be cooled that is removably attached to the coupler thereby enabling cartridge cases of different calibers to be used to cool guns of different calibers.

19 Claims, 6 Drawing Sheets

(56) References Cited

U.S. PATENT DOCUMENTS

| | | | | | |
|---|---|---|---|---|---|
| 2,764,914 | A | | 10/1956 | Young | |
| 2,985,979 | A | | 5/1961 | Doyle et al. | |
| 3,771,414 | A | * | 11/1973 | Graham | F41A 13/04 102/700 |
| D231,703 | S | | 5/1974 | Grube | |
| 4,159,588 | A | | 7/1979 | Pfeiffer | |
| 4,535,676 | A | * | 8/1985 | Politzer | F41A 13/04 89/14.1 |
| 4,843,750 | A | * | 7/1989 | Blase | F41A 29/00 102/442 |
| 5,117,734 | A | * | 6/1992 | Rhoads | F41A 13/10 89/1.2 |
| 5,202,530 | A | | 4/1993 | Stephens | |
| 5,233,124 | A | | 8/1993 | Peterson | |
| 6,023,873 | A | | 2/2000 | Baird | |
| 6,311,602 | B1 | * | 11/2001 | Gerber | F41A 13/04 89/1.25 |
| 6,591,732 | B2 | | 7/2003 | Gerber et al. | |
| 6,668,480 | B1 | * | 12/2003 | Riley | F41A 29/00 15/3.5 |
| 6,705,195 | B1 | * | 3/2004 | Thornton | F41A 13/10 89/14.1 |
| 7,143,821 | B2 | | 12/2006 | Meissner et al. | |
| 7,356,961 | B2 | | 4/2008 | Williams | |
| 7,594,463 | B2 | * | 9/2009 | Skinner | F41A 29/00 89/1.2 |
| 8,256,406 | B1 | * | 9/2012 | Kirkpatrick | F41B 11/723 102/440 |
| 8,677,879 | B1 | * | 3/2014 | Gresham | F41A 13/04 42/106 |
| 8,763,509 | B1 | * | 7/2014 | Nagel | F41A 13/10 261/152 |
| 2002/0083823 | A1 | * | 7/2002 | Gerber | F41A 13/04 89/1.25 |
| 2003/0167909 | A1 | | 9/2003 | Matter | |
| 2004/0244572 | A1 | * | 12/2004 | Borgwarth | F41A 13/00 89/17 |
| 2006/0218735 | A1 | | 10/2006 | Parker-Smith | |
| 2007/0039224 | A1 | * | 2/2007 | Skinner | F41A 29/00 42/106 |
| 2009/0049732 | A1 | * | 2/2009 | Kissinger | F41A 13/10 42/106 |
| 2010/0192596 | A1 | | 8/2010 | Quisenberry et al. | |
| 2010/0212207 | A1 | * | 8/2010 | Laney | F41A 13/04 42/90 |
| 2016/0146562 | A1 | * | 5/2016 | Roessler | F41A 29/04 42/90 |
| 2017/0082387 | A1 | * | 3/2017 | Sumoba | F41A 9/53 |

* cited by examiner

GUN BARREL COOLER

CROSS-REFERENCE

This application claims priority in U.S. Provisional Patent Application No. 62/204,054, filed Aug. 12, 2015, under 35 U.S.C. § 119(e), the entirety of which is hereby expressly incorporated herein by reference.

FIELD

The present invention is directed to a cooling device and more particularly to an improved cooling device for cooling a barrel of a gun.

BACKGROUND

Considerable heat is typically generated during the use and operation of a firearm, as a result of energy released by propellant, e.g., gunpowder, ignited during firing of the firearm to propel a projectile, e.g., bullet, through a barrel of the firearm. As the firearm is repeatedly fired, the energy released in the form of heat builds up in parts of the firearm, which can adversely affect firearm operation if the firearm gets too hot. While excessive heat buildup in the receiver of the firearm can interfere with use when it becomes too hot to touch, excessive heat buildup in the barrel of the firearm can cause the barrel to thermally distort or warp reducing accuracy. Even worse, heat buildup can become so great that it can actually cause the firearm to cease operating until it cools off and reaches a lower temperature where it will properly operate again. Where excessive heat buildup interferes with firearm operation, it can require a wait of several minutes to over an hour in order for the firearm to cool down enough to resume operation.

While many devices have been developed in the past to try to remedy such heat related firearm problems, they too are not without drawbacks. U.S. Pat. No. 7,143,821 discloses an apparatus for cooling metal tubes using a rather large enclosure which receives part of the tubular barrel and the receiver of a rifle to be cooled using outside air blown into the enclosure by a fan mounted to the enclosure. While claiming to be portable, the large size of the enclosure of the apparatus actually makes it rather bulky to use and unwieldy to transport. In addition, the cooling boot of the apparatus through which the rifle extends when inserted into the cooling apparatus has an aperture so large that the apparatus is prone to leakage of cooling air reducing cooling efficiency. Since cooling air entering the apparatus is not injected directly into the rifle, cooling efficiency is even further reduced.

While U.S. Pat. No. 5,117,734 discloses a rifle bore cooler that injects air directly into the bore of the barrel of a rifle to be cooled, it does so through the muzzle end of the barrel. Where the breech or ejection port of the rifle is covered by the bolt or another portion of the rifle, cooling air flow through the barrel is obstructed enough to significantly reduce cooling efficiency. Unless the breech or ejection port is first opened, air flow through the barrel will be so obstructed that cooling will be rather significantly reduced rendering the rifle bore cooler nearly ineffective.

What is needed is a light weight, portable, and transportable firearm cooler that is capable of cooling down of the firearm after being heated after repeated firings. What also is needed is a firearm cooler that possesses greater cooling efficiency and lower loss or leakage of barrel coolant during operation.

SUMMARY

The present invention is directed to a gun barrel cooler for use in cooling a firearm that preferably is a gun, such as a rifle, e.g., bolt-action or semi-automatic rifle, after being fired enough to heat up a barrel of the firearm. The barrel cooler includes a barrel coolant pump connected by a barrel coolant fluid conveying conduit, such as an elongate flexible hose, to a gun barrel coolant discharge nozzle that is received in a chamber of the firearm being cooled. A preferred barrel coolant pump is a portable, e.g., hand-held, battery powered centrifugal blower that can be of reversible-flow or dual mode construction operable in a barrel cooling mode to cool a gun barrel and in a vacuum mode to vacuum dirt, dust and other debris.

The nozzle preferably is formed of an empty cartridge case of substantially the same caliber as the firing chamber of the gun to be cooled using the barrel cooler. The nozzle preferably is removably threadably attached to a discharge nozzle coupler used to connect the nozzle to the hose of the conduit. A preferred nozzle is three dimensionally contoured to substantially conform to the three-dimensional interior shape of the firing chamber of the gun to be cooled. Such a preferred nozzle formed of an empty cartridge case of substantially the same caliber as that of the gun to be cooled preferably has a through bore extending through an end wall of the cartridge case that preferably is internally threaded to removably threadably engage an externally threaded nozzle attachment fitting of the discharge nozzle coupler.

Use of such a nozzle that has a three-dimensional shape that substantially conforms to the shape of the firing chamber of the gun to be cooled advantageously reduces and preferably substantially minimizes leakage of barrel coolant during gun cooling operation. By removably attaching the nozzle, e.g. modified empty cartridge case of substantially the same caliber as the gun to be cooled, to the nozzle coupler, a barrel cooler of the present invention advantageously enables at least a plurality, preferably at least a plurality of pairs, i.e. at least three, of differently sized nozzles, preferably at least a plurality, more preferably at least a plurality of pairs, of modified empty cartridge cases of different calibers thereby enabling a barrel cooler of the present invention to be used to cool at least a plurality of, preferably at least a plurality of pairs of different caliber guns.

A preferred barrel cooler of the present invention utilizes a barrel coolant pump that preferably is a centrifugal fan blower that is of lightweight, portable and transportable construction with an integrally formed handle with an operating control, preferably operating switch, that is of one handed operational construction thereby enabling a user to hold and operate the blower using one hand. One preferred barrel cooler blower utilizes a centrifugal fan impeller of improved barrel coolant flow rate construction that increases cooling efficiency.

Such a barrel cooler of the present invention advantageously reduces barrel and gun temperature more rapidly by the blower discharging a greater flow rate of barrel cooling air that cools the barrel of the gun from inside of the barrel to the outside of the barrel helping to more rapidly bring down the temperature of the gun after repeated firing.

These and other objects, features and advantages of this invention will become apparent from the following detailed description of the invention and accompanying drawings.

DRAWING DESCRIPTION

One or more preferred exemplary embodiments of the invention are illustrated in the accompanying drawings in which like reference numerals represent like parts throughout and in which:

FIG. 1 is a perspective view of a firearm whose barrel is being cooled by a barrel cooler constructed in accordance with the present invention having a blower mounted to the stock of the gun and connected by tubing or hose to a barrel coolant discharge nozzle that is three dimensionally contoured to substantially complementarily conform to the shape of the chamber of the firearm to provide a better seal therewith;

Figure 5:
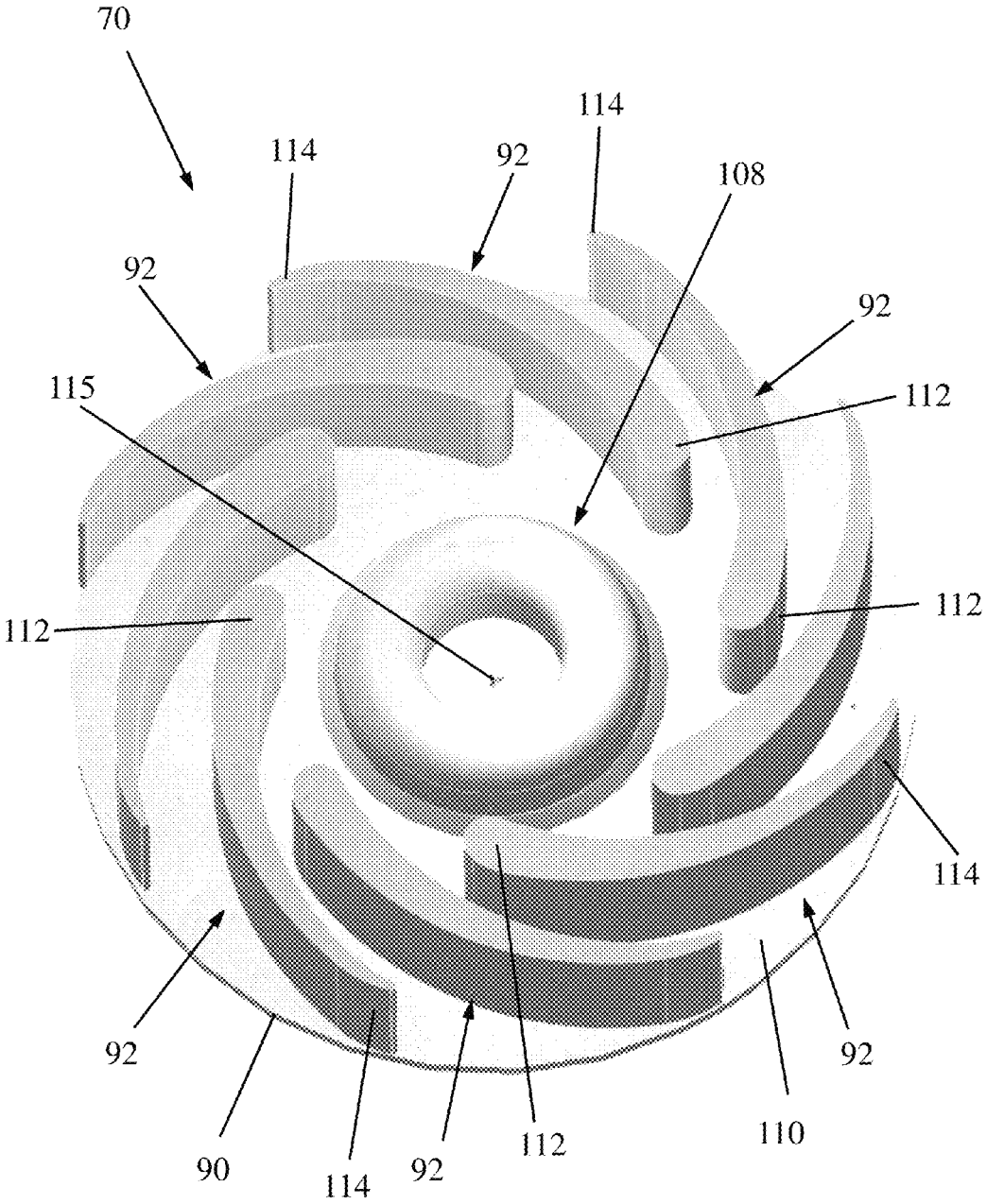
Figure 6E:
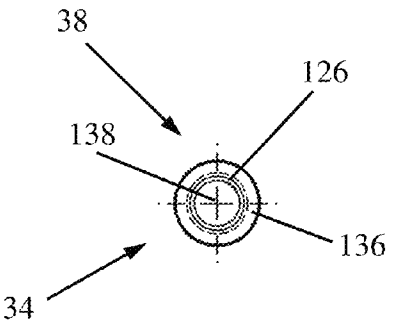
Figure 6C:
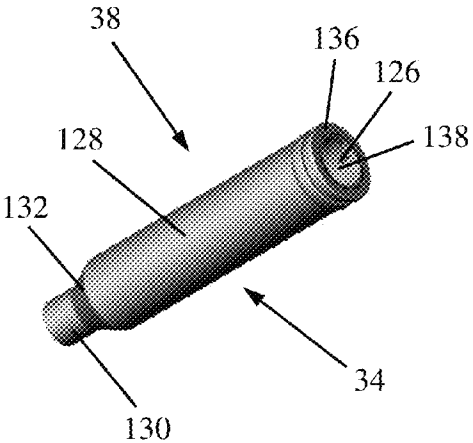
Figure 6A:
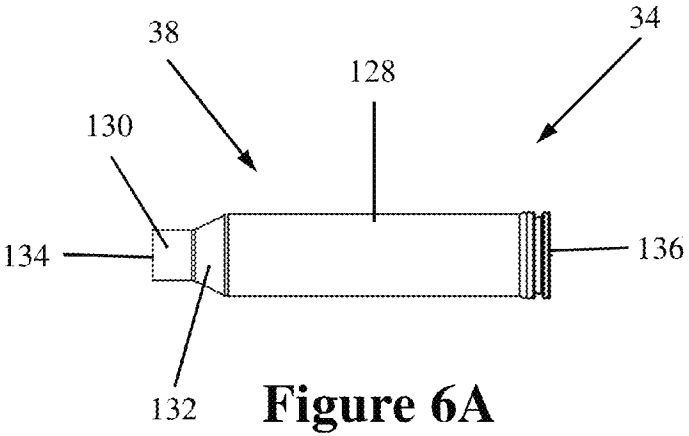
Figure 6D:
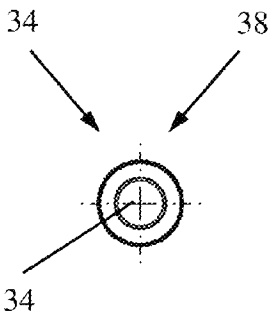
Figure 6B:
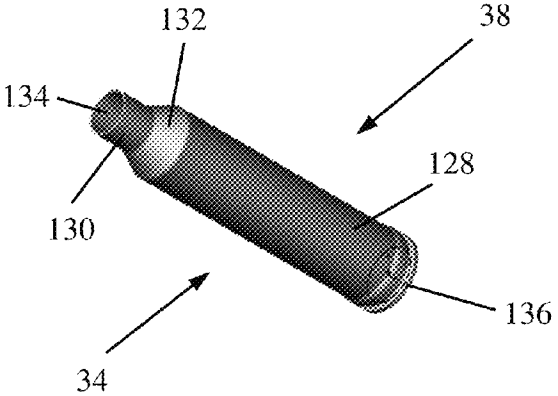

FIG. 5 is a front elevation view of a preferred embodiment of a fan blade carrying centrifugal fan impeller used in the barrel coolant blower that improves the flow rate of barrel coolant discharge from the blower during barrel cooler operation; and FIGS. 6A-6E illustrate various views of a preferred embodiment of a barrel coolant discharge nozzle constructed in accordance with the present invention that is formed of an empty cartridge case of substantially the same caliber as the gun being cooled with the barrel cooler.

Before explaining one or more embodiments of the invention in detail, it is to be understood that the invention is not limited in its application to the details of construction and the arrangement of the components set forth in the following description or illustrated in the drawings. The invention is capable of other embodiments, which can be practiced or carried out in various ways. Also, it is to be understood that the phraseology and terminology employed herein is for the purpose of description and should not be regarded as limiting.

DETAILED DESCRIPTION

FIGS. 1-6 illustrate a preferred embodiment of a gun barrel cooler 20 for cooling a gun 22 during operation formed of an assembly 24 (FIG. 3) of gun barrel cooling components producing a gun barrel cooler 20 in accordance with the present invention that is advantageously of portable, transportable, battery-powered, lightweight, and single-person operable construction which also beneficially enables quick and easy setup during barrel cooling use and which is simple to break down, e.g. take apart, and store after use. A preferred assembly 24 of components forming a barrel cooler 20 of the present invention includes a source of barrel coolant 26, preferably a barrel coolant pump 28, a barrel coolant transport conduit 30, preferably an elongate section of tubing or hose 32, used to deliver barrel coolant to the gun 22 to be cooled, a barrel coolant discharge nozzle 34, and a barrel coolant discharge nozzle coupler 36 used to couple the nozzle 34 to the tubing or hose 32 of the barrel coolant transport conduit 30. During operation of the barrel cooler 20, barrel coolant is expelled from the pump 28 through the tubing or hose 32 to the coupler 36 through the nozzle 34 into an elongate bore 40 formed in an elongate metallic, e.g., metal, barrel 42 of the gun 22 thereby cooling at least the barrel 42 of the gun 22. In a preferred barrel cooling assembly 24 and barrel cooler 20 of the present invention, the nozzle 34 is formed of an empty cartridge case 38 that preferably is of substantially the same caliber as the firearm 22 to be cooled by the barrel cooler 20 that advantageously optimizes flow of barrel coolant through the bore 40 in the gun barrel 42 during barrel cooling by providing a better seal therewith.

Figure 4:
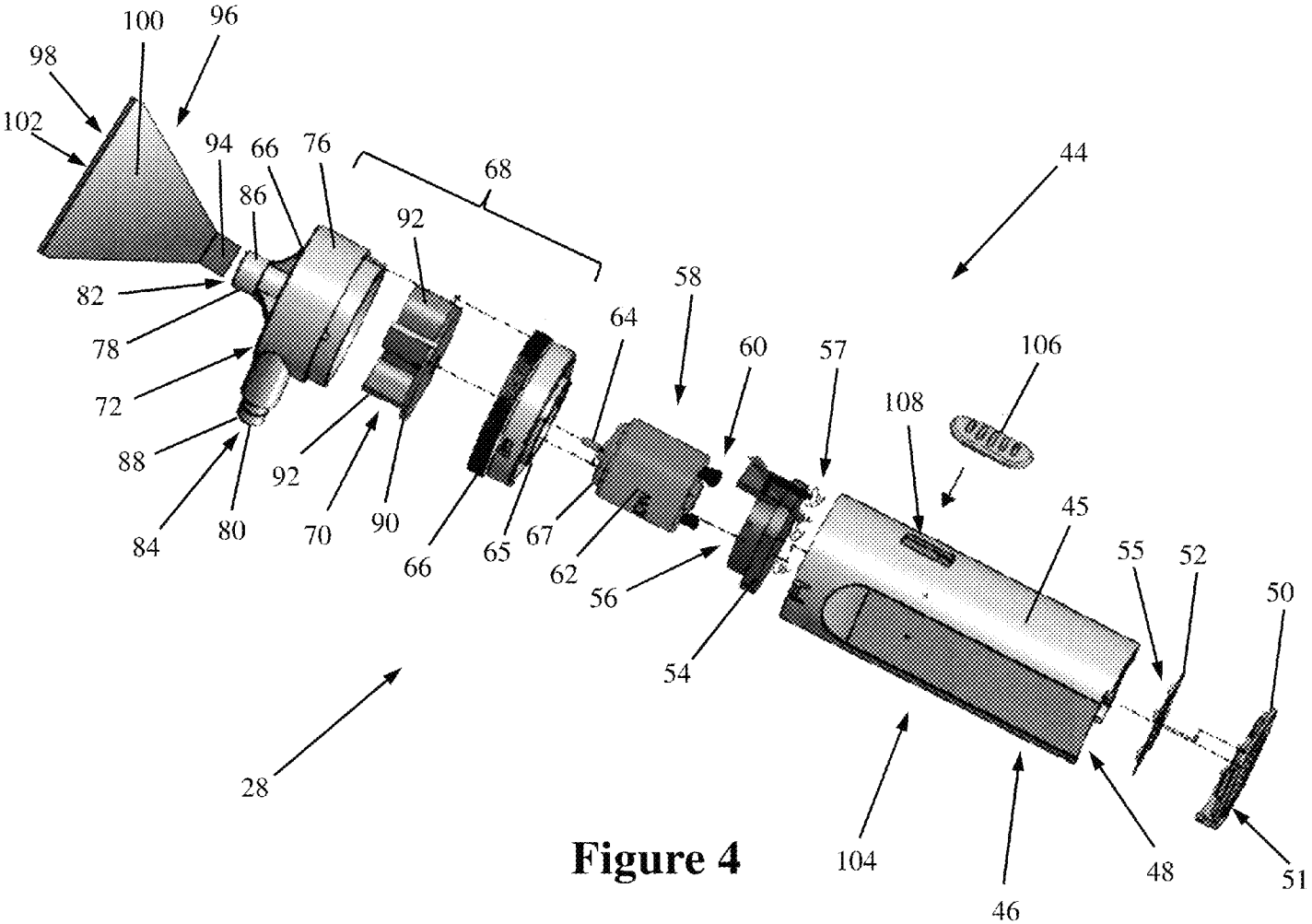
FIG. 4 is an exploded perspective view of a barrel coolant blower of the present invention used in the preferred gun barrel cooler embodiment shown in FIG. 3.

With reference to FIG. 4, a preferred barrel coolant source 26 is a barrel coolant pump 28 that more preferably is a centrifugal blower 44 that is of lightweight, handheld, and battery powered construction that also advantageously has a relatively high barrel coolant discharge flow rate relative to the weight and electrical input power of the blower 44. The blower 44 has an elongate generally cylindrical plastic housing 46 with a battery compartment 48 disposed within a generally cylindrical housing sidewall 45 in which a power supply (not shown), such as one or more batteries, preferably a plurality of AA batteries, is received that is used to electrically power the blower 44. In a preferred embodiment, the blower 44 is powered by four removable and/or replaceable AA batteries (not shown) that can be alkaline batteries, rechargeable lithium batteries, rechargeable nickel-cadmium batteries, or another type of battery that can be rechargeable.

The blower 44 has a removable battery compartment cover 50 at one end, e.g., a bottom end, of the blower housing 46 that releasably engages the housing 46 to enable the cover 50 to be detached or sufficiently disengaged to allow insertion and/or removal of batteries through the open end of the battery compartment 48 at the bottom of blower housing 46. The battery cover 50 can and preferably does also carry a battery contact board 52, preferably fixed thereto, with the battery contact board 52 having a plurality of battery terminals and/or electrical contacts 55 used to electrically connect the batteries of the blower power supply in parallel and/or in series with one another. The battery cover 50 preferably is substantially flat or planar thereby defining a pedestal 51 upon which the blower 44 can be uprightly stood on a generally flat or planar surface, such as a table top, bench, floor, or other generally flat or planar surface.

The other end of the battery compartment 48 is defined by a generally circular internal battery compartment endwall 54 disposed within the blower housing 46 that also is equipped with a plurality of battery terminals and/or electrical contacts 57 on a side of the endwall 54 facing toward the battery compartment 48 that also is used to electrically connect the batteries of the blower power supply in parallel and/or in series with one another. Battery compartment 48 therefore is preferably defined by battery compartment endwall 54, at one end of the battery compartment 48, and removable battery cover 50, disposed at an opposite end of the battery compartment 48, with the battery cover 50 and battery compartment endwall 54 spaced from one another by a portion of the generally cylindrical sidewall 45 of blower housing 46.

With continued reference to FIG. 4, a side of the battery compartment endwall 54 facing away from the battery compartment 48 preferably is three dimensionally configured to provide a centrifugal blower fan motor holder 56 to which an electrical centrifugal blower fan motor 58 is anchored in a manner that also electrically connects the motor 58 via terminals and/or contacts 57 to the batteries of the centrifugal blower power supply disposed in battery compartment 48. As is shown in FIG. 4, motor 58 has a pair of motor-anchoring electrical contacts 60 which extend outwardly in one direction from a core or base 62 of the motor 58 which preferably snap-fit or rotatively snap-fit, e.g., rotate, into motor position locking anchoring engagement with the fan motor holder 56 of battery compartment endwall 54 in a manner that also electrically connects the motor contacts 60 via battery compartment endwall terminals and/or contacts 57 to batteries received in battery compartment 48.

Extending outwardly from the motor core or base 62 in an opposite direction is a rotary output shaft 64 of the motor 58 that extends through one centrifugal blower fan chamber endwall 66 disposed within the blower housing 46 into a centrifugal blower fan chamber 68 and which is connected to a rotary centrifugal blower fan impeller 70 disposed in the fan chamber 68 for rotation of the impeller 70 substantially in unison with the motor shaft 64. As also shown in FIG. 4, fan chamber endwall 66 has a radial motor seating lip 65 extending axially outwardly toward an upraised circular shoulder 67 of the core or base 62 of the motor 58 that generally coaxially receives and preferably frictionally engages the shoulder 67 thereby seating the fan chamber endwall 66 against the output shaft end of the motor 58 during assembly of the blower 44.

An end cap 72 of the blower 44 has an endwall 74 that not only defines an endwall of the blower 44 but which also provides the other endwall of the centrifugal blower fan chamber 68 that is disposed at an end of the fan chamber 68 opposite fan chamber endwall 66. Blower end cap 72 also has an annular sidewall 76 extending axially outwardly from the blower-end fan chamber endwall 74 that defines a sidewall of the fan chamber 68 that extends to and engages with the motor-end fan chamber endwall 66 defining a generally cylindrical fan chamber 68 in which the impeller 70 is rotatively received. When the blower 44 is assembled, the end cap 72 gas tightly engages with the end of the blower housing 46 that is disposed opposite the battery compartment 48 preferably with a portion of the end cap 72 generally coaxially and slidably telescopically received within the housing 46 in the manner depicted in FIG. 4 thereby forming a substantially gas tight centrifugal blower fan chamber 68 when blower assembly is completed.

With continued reference to FIG. 4, the blower 44 also has a pair of fluid-conveying passages 78 and 80 in fluid-flow communication with the centrifugal blower fan chamber 68 with one of the fluid-conveying passages 78 defining a centrifugal blower intake 82 and the other one of the fluid-conveying passages 80 oriented generally transversely, e.g., right-angled, to fluid-conveying passage 78 and defining a centrifugal blower discharge 84 when the motor 58 rotates the impeller 70 in one rotational direction. As also shown in FIG. 4, fluid-conveying passage 78 is formed of a first generally cylindrical tubular fluid-coupling 86 extending axially outwardly from the fan chamber 68, and fluid-conveying passage 80 is formed of a second generally cylindrical tubular fluid-coupling 88 extending radially outwardly from the fan chamber 68 generally transversely, e.g., generally perpendicular, to the first fluid-coupling 86.

As also depicted in FIG. 4, axially extending fluid-coupling 86 is integrally formed of one part of blower end cap 72, preferably integrally formed of part of the end cap endwall 74, and preferably extends axially outwardly from a center of the endwall 74 and which preferably is generally coaxial with an axis of rotation of the impeller 70 and/or the motor output shaft 64. As further depicted in FIG. 4, radially extending fluid-coupling 88 is integrally formed of part of another part of the blower end cap 72, preferably integrally formed of part of the end cap sidewall 76, and preferably extends radially outwardly from the sidewall 76, and which preferably is disposed radially outwardly of and/or generally tangent to or with (a) an outer radial peripheral edge 90 of the impeller 70 and/or (b) radially extending fan blades 92 of the impeller 70.

While the intake 82 can be configured to directly intake ambient air external to the gun 22 to be cooled, intake 82 preferably includes axially extending generally cylindrical tubular fluid-coupling 86 that preferably is configured for releasable but secure generally coaxial registry with and attachment to a generally cylindrical tubular fluid-coupling 94 of an intake plenum 96 having a barrel coolant air intake opening 98 at or adjacent the free end of the plenum 96 in fluid-flow communication with a generally triangular converging or reducing plenum chamber 100 that necks down, reduces, or converges from at or adjacent intake opening 98 to at or adjacent plenum fluid-coupling 94. As is also shown in FIG. 4, the intake plenum 96 preferably has a substantially enlarged intake opening 98 with an intake opening surface area that is at least a plurality of times, preferably at least a plurality of pairs of, i.e., at least three, times greater than the surface area of the opening in the free end of fluid-coupling 86 that is in fluid-flow communication with passage 78 through which ambient barrel coolant air enters the centrifugal blower fan chamber 68 during barrel cooler operation to help ensure maximum flow rate of barrel coolant air discharged from the nozzle 34 into the barrel 42 of the gun 22 being cooled.

To prevent dirt and debris from entering the blower 44 during barrel cooler operation and being discharged from nozzle 34 into the barrel 42 of the gun 22 being cooled, blower 44 preferably is equipped with a barrel coolant air filter disposed inline with the flow ambient barrel coolant intake air entering the centrifugal blower fan chamber 68, with such a barrel coolant air filter preferably disposed between ambient barrel coolant air drawn through the intake 82 and the centrifugal blower fan chamber 68. Where the blower 44 is equipped with an intake plenum 96 attached via coupling 94 to coupling 86 of the intake 82 of the fan chamber 68 of the blower 44, the plenum 96 preferably is equipped with a barrel coolant air filter 102 that preferably is seated in the plenum chamber 100 and disposed between the intake opening 98 and the fluid-coupling 94 of the plenum 96. In another preferred embodiment, barrel coolant air filter 102 preferably is disposed in a throat of the plenum chamber 100 where the coupling 94 and chamber 100 converge or meet. In still another preferred embodiment, barrel coolant air filter 102 is disposed in the fluid-coupling 94 of the plenum 96. In a still further preferred embodiment, barrel coolant air filter 102 is disposed in the fluid-coupling 86 of the air intake 82 of the blower 44. Such a barrel coolant air filter 102 preferably is formed of a fibrous filter media, such as fiberglass filter media, a polyester filter media, pleated filter media, or another type of porous or perforate filter media suitable for air filtering that can be reusable and/or washable in construction.

In a preferred embodiment, the generally cylindrical and elongate blower housing 46 defines a manually graspable handle 104 that enables a user to easily grasp and operate the blower 44 using only one hand such that the blower 44 of the barrel cooler 20 is configured for one-handed operation advantageously facilitating ease-of-use in operating the blower 44 and/or barrel cooler 20. Blower 44 has a user manipulable switch actuator 106 slidably carried by the handle 104 of the blower housing 46 that actuates an electrical switch 108 electrically connected (a) to the batteries of the power supply in the battery compartment, and (b) to the motor 58 that is configured to control operation of the blower 44 by controlling application of electrical power supplied to the motor 58 that drives the impeller 70. In a preferred blower embodiment, switch 108 is a two-way switch or on-off switch configured to turn the motor 58 and blower 44 on when the switch actuator 106 is manipulated by a user of the gun barrel cooler 20 operating the blower 44.

In another preferred blower embodiment, switch 108 is at least a three-way switch, preferably a single pole, double throw switch or a double pole, double throw switch, configured to enable the direction of rotation of the impeller 70 and output shaft of the motor 58 to be reversed producing another preferred embodiment of a barrel cooler 20 of the present invention having a selectively configurable blower 44 that is convertible between a blower or centrifugal fan during barrel cooler operation and a vacuum such as where it is desired to reverse airflow in order to clean part of the gun 22. Where the blower 44 is configured for reverse air flow operation, manipulating the switch actuator 106 in one direction operates the blower 44 in barrel cooling mode causing barrel cooling air to be discharged out the nozzle 34 into the gun barrel 42 cooling the barrel 42 and manipulating the switch actuator 106 in an opposite direction operates the blower 44 in a vacuum cleaner mode that reverses the direction of the motor 58 and impeller 70 thereby reversing the direction of airflow so that air flows in a direction opposite when operating in barrel cooling mode.

Figure 1:
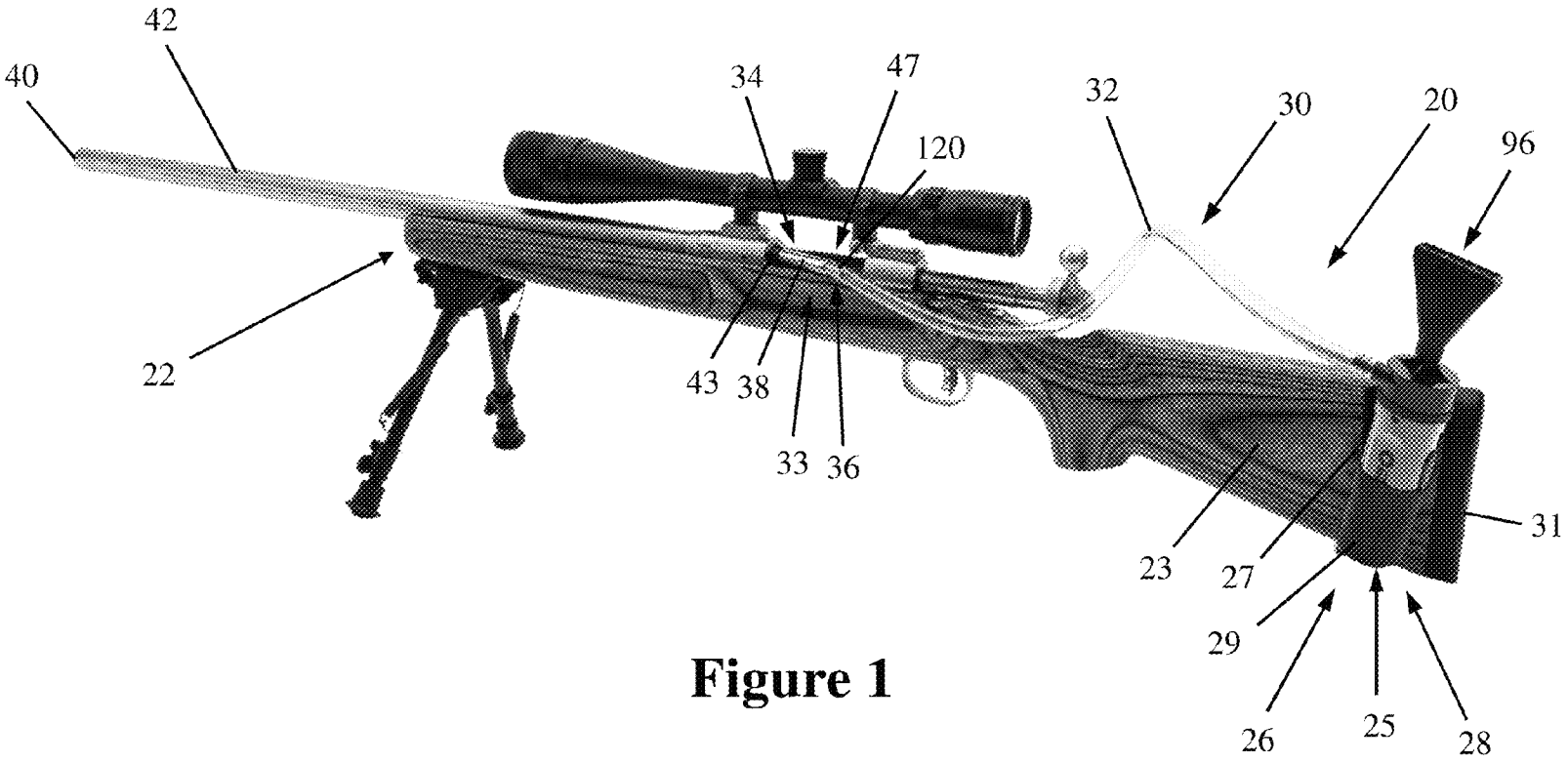

In addition to the manually graspable handle 104 formed by a generally cylindrical portion of the blower housing 46 enabling one-handed operation by a user of the barrel cooler 20, the relatively light weight and small size of the blower 44 advantageously also facilitates one handed operation of the blower 44 and barrel cooler 20 for extended periods of time. In a preferred embodiment, the blower 44 of the barrel cooler 20 has a relatively light weight of no greater than 225 grams or less than one-half of a pound when equipped with four AA batteries in its battery compartment 48, and which preferably has a weight of no greater than 110 grams or no greater than 0.25 pounds, preferably no greater than 90 grams or no greater than 0.20 pounds, and more preferably no greater than about 80 grams or no greater than about 0.18 pounds, with all batteries removed from the blower 44 and the blower 44 completely disconnected from the plenum 96 and tubing 32. In such a preferred embodiment, the blower 44 has an outer diameter or maximum width no greater than a width of a stock 23 of the gun 22 to be cooled using the barrel cooler 20, preferably no wider than three inches, and preferably has a height of no greater than five inches, enabling the blower 44 to be removably mounted to the stock 23 of the gun 22, such as in the manner depicted in FIG. 1, thereby advantageously enabling simple, quick and easy switchover between shooting of the gun 22 and cooling of the gun 22 using the barrel cooler 20 to be performed. In a preferred embodiment, the blower 44 of the barrel cooler 20 can be mounted by a sleeve 25 equipped with a plurality of generally transversely oriented loops or pockets 27, 29 with one of the loops or pockets 27 receiving a portion of the gun stock 25 attaching it thereto and the other one of the loops or pockets 29 receiving at least a portion of the handle 104 of the blower 44 removably mounting the blower 40 to the gun 22 being cooled. As shown in FIG. 1, when the blower 44 is mounted to the gun 22 being cooled, the blower mounting sleeve 25 generally perpendicularly orients the blower 44 in a generally vertical or upright position relative to the generally horizontally extending stock 25 of the gun 22 being cooled. When removably mounted to the gun 22 to be cooled using the barrel cooler 20 and/or during cooling of the gun 22 using the barrel cooler 20, the blower 44 preferably is mounted to or on the stock 23 of the gun 22 forward the of a butt or end 31 of the stock 23 of the gun 22 between the butt 31 and receiver 33 of the gun 22 enabling the barrel cooler 20 to be operated to cool the barrel 42 of the gun 22 in between firing of the gun 22.

FIG. 5 illustrates a rotary centrifugal blower fan impeller 70 of the present invention that is configured to advantageously provide an increased volumetric flow rate of barrel cooling air discharged from the nozzle 34 during gun cooling during barrel cooler operation thereby cooling and reducing gun barrel temperature more rapidly. Impeller 70 is advantageously configured to provide greater barrel cooling air flow per watt of blower motor power during operation of the blower 44 during barrel cooler use and operation. Impeller 70 has a generally annular upraised central impeller hub 108 with a center opening 115 formed therein that can be and which preferably is configured to register or otherwise mate with the shaft 64 of the blower motor 58 in a manner that causes the impeller 72 to rotate substantially in unison with the blower motor shaft 64 about an axis substantially coincident or coaxial with opening 115 during operation of the blower 44. The increased air flow producing impeller 70 has at least a plurality of pairs, i.e., at least three, impeller fan blades 92 each extending radially outwardly from the hub 108 in the manner depicted in FIG. 5. In the preferred embodiment of the impeller 70 shown in FIG. 5, the fan blades 92 and/or hub 108 are carried by and/or extend axially outwardly from a generally circular or generally annular impeller disk 110 with impeller disk 110 being flat or generally planar, concave or convex.

Each impeller fan blade 92 is airfoil shaped, preferably forwardly curved, has an enlarged width or thickness root 112 at one end disposed adjacent hub 108, and which is substantially continuously curved, preferably substantially continuously forwardly curved in the direction of impeller rotation, toward an outer peripheral edge 90 of the disk 110 substantially continuously tapering or narrowing in thickness toward a radially outer tip 114 thereof. As is also shown in FIG. 5, each outer fan blade tip 114 preferably defines a leading edge of each airfoil shaped forwardly curved airflow volume increasing fan blade 92 that can and preferably does converge to a point with the thicker radially inwardly disposed root 112 of each blade 92 defining a trailing edge of each blade 92. The impeller fan blades 92 preferably are concentrically symmetrically arranged as shown in FIG. 5 thereby increasing volumetric flow rate over conventional impellers by at least 20%, preferably by at least 25%, and more preferably by at least 30% thereby producing a barrel cooler blower 44 that advantageously provides more rapid gun and barrel cooling.

In use of the gun barrel cooler 20 of the present invention, the elongate section of barrel coolant air conveying tubing or hose 32 has one end substantially fluid tightly engaged with the fluid-coupling 88 of the blower discharge 84 and an opposite end substantially fluid tightly engaged with the barrel coolant discharge nozzle coupler 36 that is in turn connected to the coolant discharge nozzle 34 removably seated in the chamber 43 of the receiver 33 of the gun 22 to be cooled with the barrel cooler 20. In a preferred embodiment, the barrel coolant air conveying tubing or hose 32 is flexible, generally see-through, and preferably substantially transparent with a preferred tubing or hose 32 made of polyvinyl chloride (PVC) or another suitable elastomeric or plastic material. In a preferred embodiment, the tubing or hose 32 has a length of at least six inches and preferably at least about eight inches to enable the tubing or hose 32 to extend from the blower 44 mounted to the stock 23 of the gun 22 to the chamber 43 of an open or opened breech 47 of the gun 22 where the barrel coolant air discharge nozzle 34 is disposed.

As best shown in FIG. 1, the fluid coupling 88 of the blower discharge 84 is telescopically inserted into the one end of the tubing or hose 32 frictionally engaging and attaching the coupling 88 thereto, and a fluid coupling 120 of the barrel coolant discharge nozzle coupler 36 is telescopically inserted into the opposite end of the tubing or hose 32 frictionally engaging and attaching the coupling 88 thereto. In a preferred embodiment, the fluid coupling 88 of the blower discharge 84 preferably is a barbed or ribbed hose-engaging coupling that interiorly frictionally engages the tubing or hose 32 at one end thereof, and the fluid coupling 120 of the barrel coolant discharge nozzle coupler 36 preferably also is a barbed or ribbed hose-engaging coupling that also interiorly frictionally engages the tubing or hose 32 at the opposite end thereof.

Figure 2:
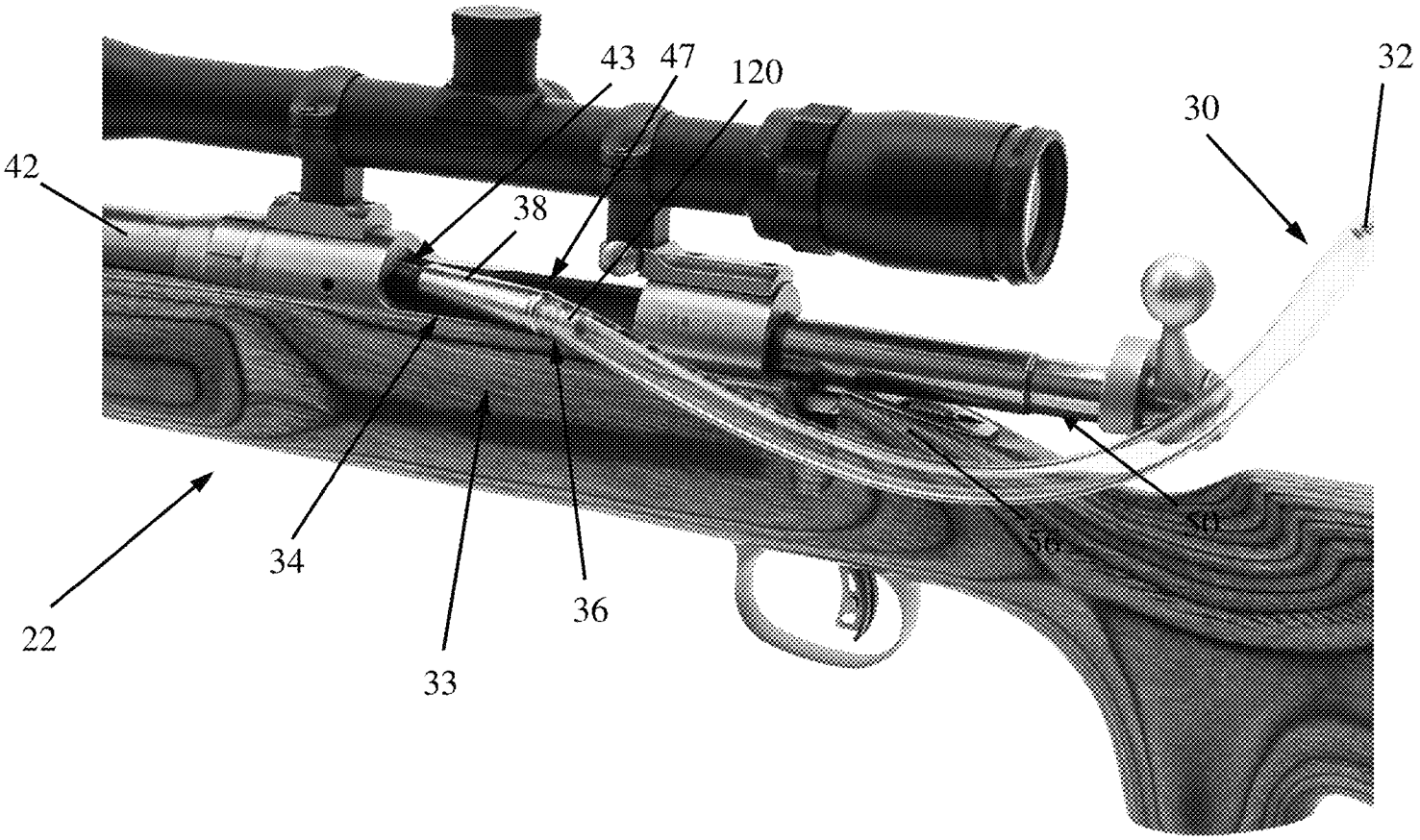
FIG. 2 is an enlarged fragmentary perspective view of the chamber, breech and a portion of the receiver of the firearm of FIG. 1 illustrating more clearly positioning of the barrel coolant discharge nozzle in the breech of the firearm so that the nozzle can be slidably telescopically inserted into the chamber for barrel cooling use.
Figure 3:
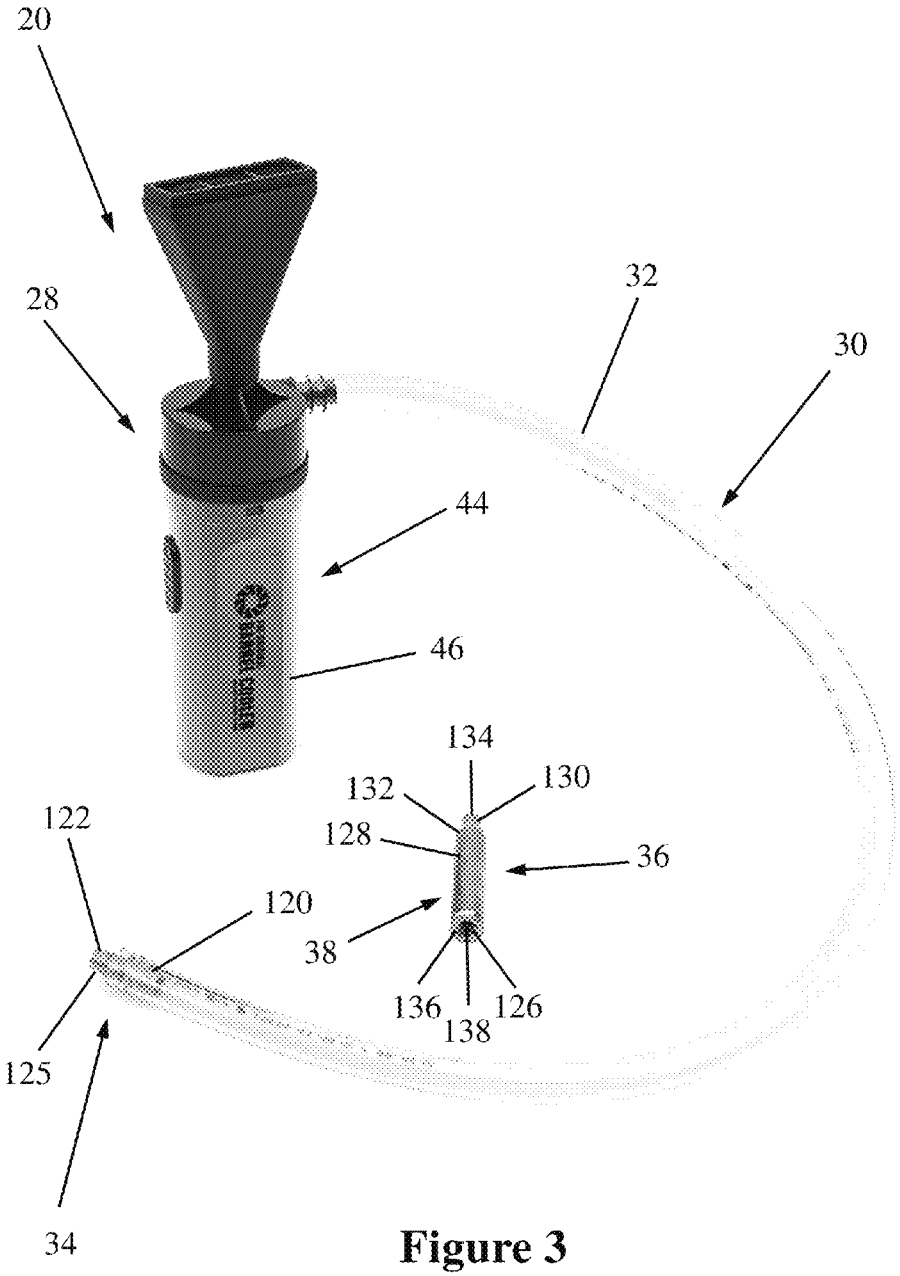
FIG. 3 is a perspective view of an assembly of components forming a gun barrel cooler constructed in accordance with the present invention for use in cooling a firearm after repeated firing of the firearm to lower the temperature of at least the barrel of the firearm.

With reference to FIGS. 1-3, the barrel coolant discharge nozzle coupler 36 has a fluid coupling 120 extending outwardly in one direction that is frictionally and telescopically inserted into engagement with one end of the tubing or hose 32 and has a barrel coolant discharge nozzle attachment fitting 122 extending in an opposite direction that is used to releasably and securely attach the coolant discharge nozzle 34 thereto in a manner permitting coolant air discharged from the blower 44 to be conveyed through the hose or tubing 32, through the coupler 36, and through the nozzle 34 into the bore 40 of the barrel 42 of the gun 22 being cooled thereby during barrel cooler operation. As discussed in more detail below, the nozzle attaching fitting 122 of the nozzle coupler 36 preferably is tubular, generally cylindrical, and externally to provide threads 125 that threadably engage one end of the discharge nozzle 34 in removably assembling the nozzle 34 to the coupler 36.

With reference to FIGS. 1-3 and 6A-6E, the barrel coolant discharge nozzle 34 is generally tubular, elongate, and has a three-dimensional contour that substantially conforms to the three-dimensional internal shape of the firing chamber 43 of the gun 22 to be cooled using the barrel cooler 20 of the present invention such that the three dimensionally contoured barrel coolant discharge nozzle 34 of the present invention provides a better more gas tight seal with the chamber 43. As a result of the nozzle 36 substantially complementarily conforming in shape to the chamber 43 providing a better seal therewith, a greater cooling flow rate or volumetric flow rate of barrel cooling air from the blower 44 is discharged from the nozzle 34 into the bore 40 of the barrel 42 thereby advantageously more efficiently cooling the barrel 42 after repeated firings of the gun 22.

In a preferred embodiment of the barrel coolant discharge nozzle 34, the nozzle 34 preferably is formed of a tubular and generally cylindrical empty cartridge case 38 which fits within the chamber 43 of the gun 33 to be cooled using the barrel cooler 20. If not procured empty, case 38 can be and preferably is emptied in preparation for being modified into nozzle 34 by removing any propellant, e.g., gunpowder, by removing any projectile, e.g., bullet, and by removing any primer. In a preferred method of making a barrel coolant discharge nozzle 34 in accordance with the present invention, an empty cartridge case 38 is provided that lacks any primer, projectile and propellant. Thereafter, empty case 38 is modified by forming the case 38 in a manner to accommodate coupling or attachment of the elongate, tubular, hollow and generally cylindrical barrel coolant discharge nozzle coupler 36 used to fluid tightly attach the nozzle 34 to the tubing or hose 32. In carrying out such a preferred method of making a barrel coolant discharge nozzle 34 in accordance with the present invention, the primer pocket and/or flash hole of the empty cartridge case 38 is internally threaded to provide internal threads 126 that threadably receive the external threads 125 of the externally threaded discharge nozzle attachment fitting 122 of the nozzle coupler 36 thereby removably attaching the nozzle 34, preferably empty cartridge case 38.

In a preferred embodiment, the nozzle 34 is an empty metallic, e.g., brass or steel, cartridge case 38 of the same caliber as the gun 22 being or to be cooled using the barrel cooler 20. By the nozzle coupler 36 and empty cartridge case 38 being removably attached to one another, a gun barrel cooler 20 and method of using such a gun barrel cooler 20 of the present invention advantageously enables use of the gun barrel cooler 20 with at least a plurality of, preferably at least a plurality of pairs of, i.e. at least three, differently sized nozzles 34 respectively sized for barrel cooler use with guns, e.g. gun 20, having at least a plurality of and preferably at least a plurality of pairs of, i.e., at least three, different caliber guns. In one such preferred gun barrel cooler 20 and method of gun barrel cooler use, the threaded fitting 122 of the nozzle coupler 36 advantageously accommodates at least a plurality of, preferably at least a plurality of pairs of differently sized discharge nozzles 34 having at least a plurality of, preferably at least a plurality of pairs of different calibers from at least the following calibers: 223 Remington, 5.56×45 mm NATO, .243 Winchester, 270 Winchester, 7 mm Winchester, 8 mm Mauser, 30-30 Winchester, .308 Winchester, .30-06 Springfield, .375 H & H, and/or .458 Winchester.

With continued reference to FIGS. 6A-6E, the barrel coolant discharge nozzle 34 preferably is an empty cartridge case 38 modified in accordance with that discussed above to produce a barrel coolant discharge nozzle 34 in accordance with the present invention that has (a) has an elongate generally cylindrical tubular casing body 128, e.g., discharge nozzle casing tube, of substantially the same outer diameter as the inner diameter of a corresponding casing body-receiving portion of the chamber 43 of the gun 22 to be cooled with the barrel cooler 20, e.g., having substantially the same caliber, and (b) has a length long enough for at least one one-third, preferably at least one-half, of the case body 128 to be slidably telescopically received in, e.g., seat in, the chamber 43 of the gun 22 to be cooled with the barrel cooler 20. Each gun caliber sized discharge nozzle 34 preferably also has a generally tubular nozzle outlet neck 130 that is narrower or smaller in diameter than the casing body 128 that is connected to the case body 128 by a diametrically necked down shoulder 132 thereby producing a discharge nozzle 34 in accordance with the present invention that preferably is formed of an empty cartridge case 38 of substantially the same caliber as the chamber 43 of the gun 22 to be cooled that has a three dimensional contour and/or shape that is substantially complementarily to the chamber 43 of the gun 22 to be cooled. In a preferred embodiment, having substantially the same caliber means that the cartridge case 38 is of substantially the same caliber as the gun 22 to be cooled or is of a caliber that is smaller than the caliber of the gun 22 to be cooled but the cartridge case 38 has a caliber within 25% of the caliber of the gun 22 to be cooled. Discharge nozzle 34 has a barrel coolant air discharge outlet opening 134 through which barrel coolant air exits that is disposed at a free end of the nozzle 34 that is disposed in the bore 40 of the barrel 42 of the gun 22 during barrel cooling of the gun 22. Discharge nozzle 34 has an end wall 136 at an end opposite the barrel coolant air discharge outlet opening 134 that has a through bore 138 formed therethrough in fluid flow communication with the interior of the nozzle 34, e.g., the interior of the empty cartridge case 38, that preferably is internally threaded to produce the internal threads 126 that threadably engaged the external threads 124 of the nozzle connector fitting 122 of the coupler 36 enabling relatively quick and easy threadable disengagement of nozzle 34, e.g. modified empty cartridge case 38 of one caliber, and further enabling quick and easy threadable engagement of another nozzle 34 having a different size, e.g., modified empty cartridge case 38 of a different caliber enabling the gun barrel cooler 20 to be used to cool at least a plurality of different caliber guns.

Understandably, the present invention has been described above in terms of one or more preferred embodiments and methods. It is recognized that various alternatives and modifications may be made to these embodiments and methods which are within the scope of the present invention. Various alternatives are contemplated as being within the scope of the claims of the present invention. It is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the invention.

What is claimed is:

1. A gun barrel cooler for a gun of a caliber that has a breech or ejector port in communication with a bore of an elongate barrel of the gun, the gun barrel cooler comprising:

(a) a source of barrel coolant;

(b) a barrel coolant discharge nozzle received in a chamber of a gun, the barrel coolant discharge nozzle in fluid-flow communication with the source of barrel coolant and having a barrel coolant discharge nozzle outlet in communication with a bore formed in the barrel;

(c) a coolant-fluid transport conduit in fluid-flow communication with the source of barrel coolant and the barrel coolant discharge nozzle; and wherein barrel coolant from the source is discharged from the barrel coolant discharge nozzle outlet into the bore in the barrel flowing through the bore and out a muzzle opening at the end of the barrel of the gun being cooled by the barrel cooler;

wherein the barrel coolant discharge nozzle comprises an empty cartridge case of substantially the same caliber as the caliber of the gun whose barrel is to be cooled;

wherein the empty cartridge case has a length with the empty cartridge case having at least two different diameters along the length; and wherein the empty cartridge case substantially conforms to a three-dimensional internal shape of the chamber.

2. The gun barrel cooler of claim 1, wherein the empty cartridge case further comprises:

a casing body with a first diameter;

a nozzle outlet neck having a second diameter, wherein the second diameter is smaller than the first diameter; and a tapered shoulder having a varying diameter extending between the casing body and the nozzle outlet neck.

3. The gun barrel cooler of claim 2, wherein the cartridge case of the coolant discharge nozzle is connected by a coupler to the coolant-fluid transport conduit.

4. The gun barrel cooler of claim 3, wherein the cartridge case of the coolant discharge nozzle is removably connected to the coupler enabling removal and replacement of one cartridge case of a first size with a cartridge case of a second size different than the first size.

5. The gun barrel cooler of claim 4, wherein the cartridge case of the coolant discharge nozzle is threadably attached to the coupler.

6. The gun barrel cooler of claim 1, wherein the barrel coolant discharge nozzle comprises a cartridge case of substantially the same caliber or smaller caliber than the caliber of the gun that is removably telescopically inserted through the breech or ejection port and into the chamber of the gun whose barrel is to be cooled.

7. The gun barrel cooler of claim 1, wherein the source of barrel coolant comprises a blower having (a) an intake that draws air from the ambient environment a distance from the barrel of the gun being cooled by the barrel cooler, and (b) a discharge in fluid flow communication with the barrel coolant discharge nozzle.

8. The gun barrel cooler of claim 7, wherein blower comprises a centrifugal fan blower.

9. The gun barrel cooler of claim 8, wherein the blower is of portable and/or hand-held construction.

10. The gun barrel cooler of claim 1, wherein the source of barrel coolant comprises a blower having a housing in which at least one battery is removably received, the housing comprising a motor with a rotary shaft to which a centrifugal fan impeller is attached that is received in a fan chamber having an intake and discharge.

11. The gun barrel cooler of claim 10, wherein the blower is of portable and/or hand-held construction.

12. The gun barrel cooler of claim 11, wherein the empty cartridge case is an empty rifle cartridge.

13. The gun barrel cooler of claim 12, wherein the empty cartridge case, is a centerfire or pin fire cartridge case.

14. The gun barrel cooler of claim 1, wherein the source of barrel coolant is carried by the gun being cooled by the barrel cooler.

15. The gun barrel cooler of claim 14, wherein the source of barrel coolant comprises a blower removably mounted to a stock of the gun to be cooled.

16. A gun barrel cooler for a gun of a caliber that has a breech or ejector port in communication with a bore of an elongate barrel of the gun, the gun barrel cooler comprising:

(a) a centrifugal fan blower;

(b) a barrel coolant discharge nozzle received in a chamber of the gun to be cooled, the barrel coolant discharge nozzle comprised of an empty cartridge case;

(c) a flexible hose in fluid-flow communication with the blower and the barrel coolant discharge nozzle; and (d) a coupler removably coupling the barrel coolant discharge nozzle to the hose;

wherein the barrel coolant discharge nozzle comprises an empty cartridge case of substantially the same caliber as the caliber of the gun whose barrel is to be cooled;

wherein the empty cartridge case further comprises:

an end wall;

a through bore formed in the end wall, the through bore having a first diameter;

a nozzle outlet neck; and a barrel coolant air discharge outlet opening formed in the nozzle outlet neck, the barrel coolant air discharge outlet opening having a second diameter;

wherein the first diameter is greater than the second diameter.

17. The gun barrel cooler of claim 16, wherein the coupler is removably threadably attached to the barrel coolant discharge nozzle.

18. A gun barrel cooler for a gun of a caliber that has a breech or ejector port in communication with a bore of an elongate barrel of the gun, the gun barrel cooler comprising:

(a) a centrifugal fan blower;

(b) a barrel coolant discharge nozzle received in a chamber of the gun to be cooled, the barrel coolant discharge nozzle comprised of an empty cartridge case;

(c) a flexible hose in fluid-flow communication with the blower and the barrel coolant discharge nozzle; and (d) a coupler removably coupling the barrel coolant discharge nozzle to the hose;

wherein the coupler is removably threadably attached to the barrel coolant discharge nozzle; and wherein the empty cartridge case of the barrel coolant discharge nozzle has an end wall at one end with a bore therethrough that is internally threaded, and wherein the coupler has an externally threaded fitting that enables the empty cartridge case to be removably threaded onto the threaded fitting of the coupler.

19. The gun barrel cooler of claim 18, wherein the empty cartridge case of the barrel coolant discharge nozzle has the same caliber as the caliber of the gun to be cooled.

* * * * *